United States Patent [19]

Mecklenburg et al.

[11] 3,972,434

[45] Aug. 3, 1976

[54] ORDER PICKER WITH OPERATOR'S PLATFORM ON THE FRONT END OF THE LOAD SUPPORT

[75] Inventors: Clifford G. Mecklenburg, Homewood, Ill.; Charles T. Evans, Rocky River, Ohio

[73] Assignee: Allis-Chalmers Corporation, Milwaukee, Wis.

[22] Filed: Dec. 23, 1974

[21] Appl. No.: 536,028

[52] U.S. Cl. ..... 214/730; 214/512

[51] Int. Cl.[2] ..... B66F 9/14

[58] Field of Search ..... 187/9 R, 9 E; 182/63, 182/148; 214/16.4 R, 16.4 A, 75 R, 75 G, 75 H, 670, 730, 512, 731

[56] References Cited

UNITED STATES PATENTS

| | | | |
|---|---|---|---|
| 3,099,332 | 7/1963 | De Marco | 187/9 R X |
| 3,176,794 | 4/1965 | Evans | 182/148 X |
| 3,263,777 | 8/1966 | Robichon | 214/16.4 A X |
| 3,282,374 | 11/1966 | Allen | 182/148 X |
| 3,643,825 | 2/1972 | Zane | 214/730 X |
| 3,757,899 | 9/1973 | Smith | 187/9 E X |
| 3,762,589 | 10/1973 | Shaffer | 214/730 |
| 3,836,031 | 9/1974 | Weisker | 214/730 |

FOREIGN PATENTS OR APPLICATIONS

| | | | |
|---|---|---|---|
| 1,522,622 | 3/1968 | France | 187/9 |

*Primary Examiner*—John J. Love
*Assistant Examiner*—James L. Rowland
*Attorney, Agent, or Firm*—Charles L. Schwab

[57] ABSTRACT

In order to maximize the load carrying capability of an order picker truck, the payload is supported on a forwardly extending load support of the carriage adjacent the mast and the operator's platform is supported on the front end of the carriage load support. This arrangement keeps the payload close to the mast and still allows the operator to be close to the payload as he goes up and down with the carriage. A lost motion connection is provided between the operator's platform and the front end of the load support. In the lowered position of the carriage, the operator's station rests on a pair of forward extending wheel supported legs of the lift truck frame and the load support is disposed between the legs.

1 Claim, 7 Drawing Figures

ORDER PICKER WITH OPERATOR'S PLATFORM ON THE FRONT END OF THE LOAD SUPPORT

RELATED PATENT APPLICATION

Some features of the truck disclosed herein are common to those of the truck shown in co-pending United States patent application of Clifford G. Mecklenburg and George J. Oakley, Ser. No. 518,789, now U.S. Pat. No. 3,910,370 entitled Disconnecting Steer System.

BACKGROUND OF THE INVENTION

Heretofore, others have provided order picker trucks wherein the operator's station is carried adjacent the mast on forwardly extending load supports of the elevatable carriage and the payload is carried on the part of the load supports extending forwardly of the operator's station. Also heretofore, others have provided a lost motion connection between the operator's compartment and the carriage of the lift truck. U.S. Pat. Nos. 3,202,242; 3,264,777; and 3,631,940 exemplify the prior art.

BRIEF DESCRIPTION OF THE INVENTION

An order picker truck includes a mid-positioned mast, a pair of forwardly extending legs which are rigidly interconnected at their forward ends and an elevatable carriage having a longitudinally extending load carrying support disposed laterally between the legs and extending forwardly of the mast. A side loading mechanism is supported on the forwardly extending load support adjacent to the mast and an operator's platform is connected to the front end of the longitudinally extending support. In the down position of the carriage, the operator's platform rests on the forward ends of the legs. A lost motion connection is provided between the forward end of the load support and the operator's platform. Upon elevation of the carriage a predetermined distance, the forwardly extending support picks up the operator's platform and transports it upwardly with the carriage. This permits the operator to more conveniently assist in loading and unloading operations, if such become necessary, and also brings his eye level closer to the side shifting mechanism attached to the load support part of the carriage.

BRIEF DESCRIPTION OF THE DRAWINGS

The present invention as incorporated in an order picker lift truck, is shown in the drawings wherein.

DETAILED DESCRIPTION OF THE DRAWINGS

Figure 2:
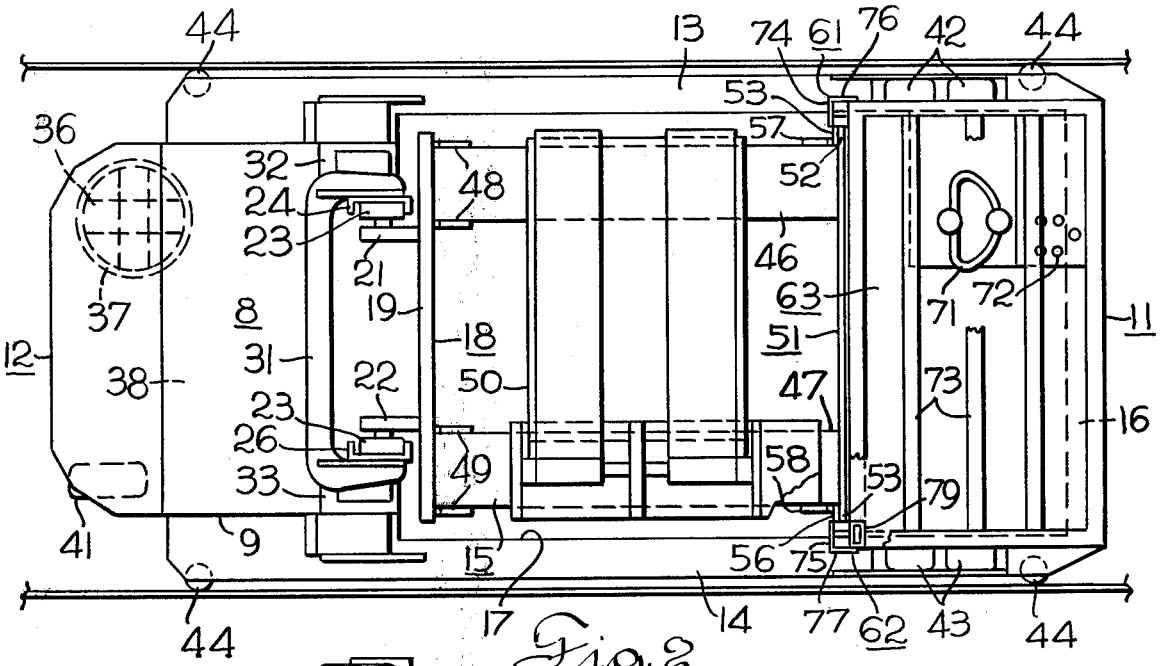
FIG. 2 is a top view of the truck shown in FIG. 1.
Figure 1:
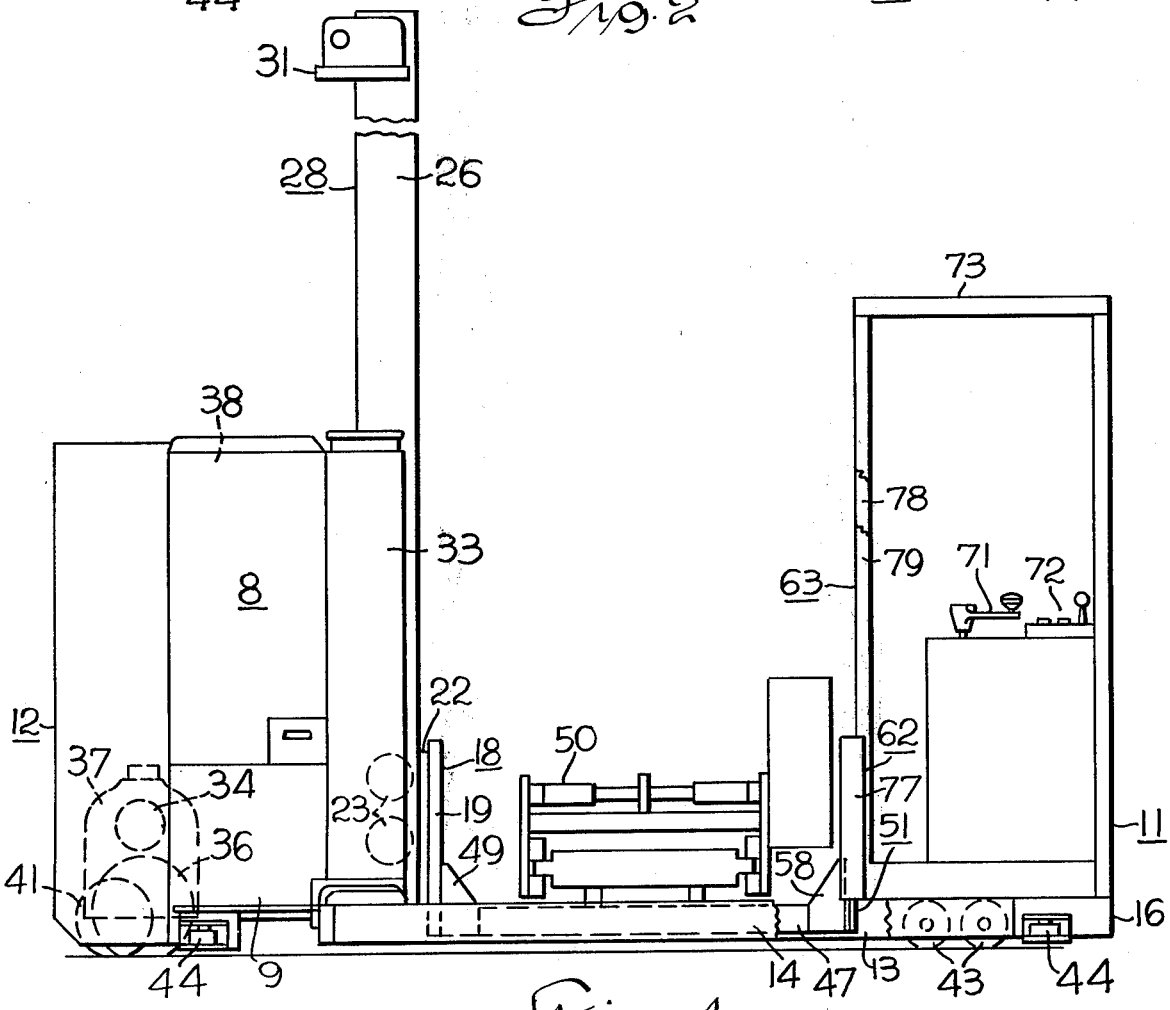
FIG. 1 is a side view of an order picker truck.

Referring to FIGS. 1 and 2, an order picker truck 8 has a main frame 9 which includes a front portion 11 and a rear portion 12. The front portion 11 of the frame is low to the floor, longitudinally elongated and includes a pair of longitudinally extending legs 13, 14 which are interconnected at their forward end by a transverse brace 16. The rear portion 12 of the frame 9, the legs 13, 14 and the front cross brace 16 form a boxlike frame presenting an upward opening pocket 17 in which the load supporting portion 15 of the carriage 18 is disposed in its down position as illustrated in FIGS. 1 and 2. The carriage 18 includes a vertical transverse carriage plate 19 which has a pair of rearwardly extending brackets 21, 22 to which carriage rollers 23 are rotatably mounted. The carriage rollers 23 operably engage the inside of a pair of upright channels 24, 26 which form part of a vertical mast structure 28 rigidly secured to the frame 9 at the rear side of the pocket 17. The upright channels 24, 26 are rigidly interconnected near their upper end by a transverse brace 31. A pair of hydraulic fluid tanks 32, 33 are rigidly connected to the frame 9 and channels 24, 26 and thus constitute an integral part of the frame 9. The illustrated truck is electrically driven by a motor 34 connected through a gear train, not shown, with a drive wheel 36 of a steerable power unit 37. Power for the motor 34 is supplied by a battery 38 disposed to the rear of the mast and hydraulic tanks 32, 33. The rear portion 12 of the lift truck frame 9 is supported by the drive wheel 36 and by a caster wheel 41. The front portion 11 of the truck frame 9 is supported by two pairs of tandem wheels 42 and 43 which are rotatably supported in the front ends of legs 13, 14. The illustrated lift truck is designed to operate in narrow aisles and in order for the truck to be properly guided within the aisles, four guide rollers 44 are rotatably mounted on the frame 9 near the floor.

Figure 3:
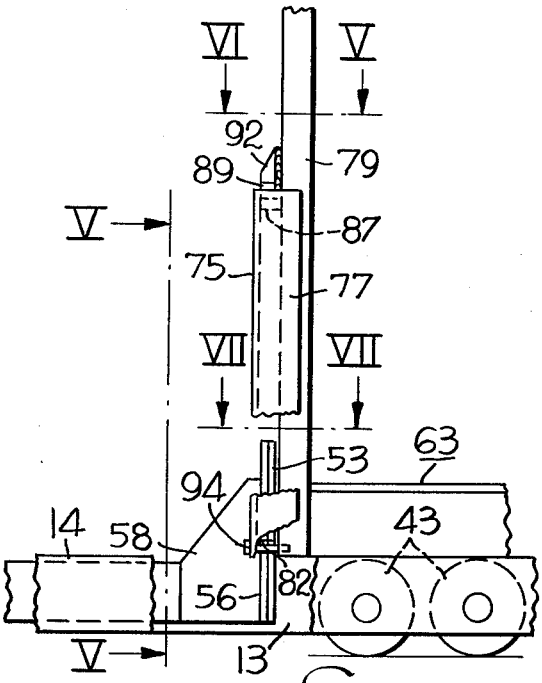
FIG. 3 is an enlarged side view showing the connection between the carriage and operator's platform with parts removed for illustration purposes.

The load support 15 of the carriage 18 includes a pair of horizontally flat and forwardly extending arms 46, 47 which are secured as by welding to the carriage plate 19; such connections being reinforced by appropriate brackets 48, 49 welded to the carriage plate 19 and to the arms 46, 47. A side loading mechanism 50 is secured to the arms 46, 47 and is operable to load and unload to either lateral side of the truck. The forward ends of the arms 46, 47 are rigidily interconnected by a transverse member in the form of a plate 51. The transverse member 51 has laterally opposite end portions 52, 53 which are reinforced by flat vertical reinforcing plates 54, 56 welded thereto. The end portions 52, 53 are further braced by brackets 57, 58 welded to the reinforcing plates 54, 56 and to the forwardly extending carriage arms 46, 47. The end portions 52, 53 together with their reinforcing plates 54, 56 serve as vertical guide structures which cooperate with a pair of complementary vertical guide structures 61, 62 on an operator's station or platform 63 at the front of the truck. As shown in FIGS. 1, 2 and 3, the operator's platform 63 is supported on the front of the forwardly extending front frame portion 11 formed by legs 13, 14 and cross brace 16. The operator's platform 63 includes a steering wheel 71 for steering the truck, other controls 72 for operating the truck and an overhead guard structure 73. The vertical guide structures 61, 62 are formed by welding vertically disposed angles 76, 77 to the vertical corner posts 78, 79 of the operator's platform 63. Referring also to FIGS. 3, 5, 6 and 7, the transversely extending legs 74, 75 of the channels 76, 77 are spaced rearwardly from the rear wall of the posts 78, 79 thereby forming a groove or track for the vertically extending end portions 52, 53 of the transversely extending member 51 of the load support 15. Each of the end portions 52, 53 and their reinforcing plates 54, 56 are notched to form downwardly facing shoulders 81, 82, the purpose of which will be explained hereinafter. The vertical guide structures in the form of end portions 52, 53 on the carriage are free to move upward relative to the operator's platform until abutments in the form of the upper surfaces 83, 84 of the end portions 52, 53 engage resilient pads 86, 87 secured to the bottom side of abutments 88, 89 welded to the posts 78, 79 and reinforced by suitable brackets 91, 92 welded to the posts 78, 79 and to the abutments 88, 89.

Figure 4:
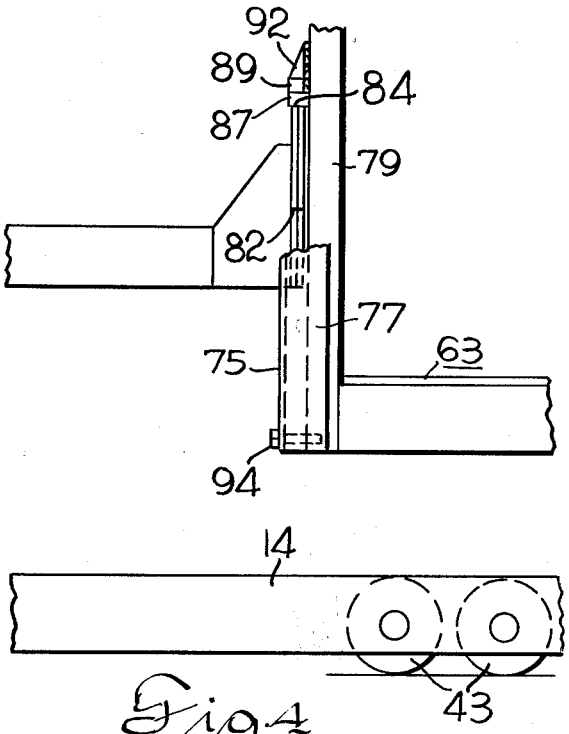
FIG. 4 is similar to FIG. 3 except showing the carriage raised through the lost motion connection with the operator's platform and supporting the latter.
Figure 5:
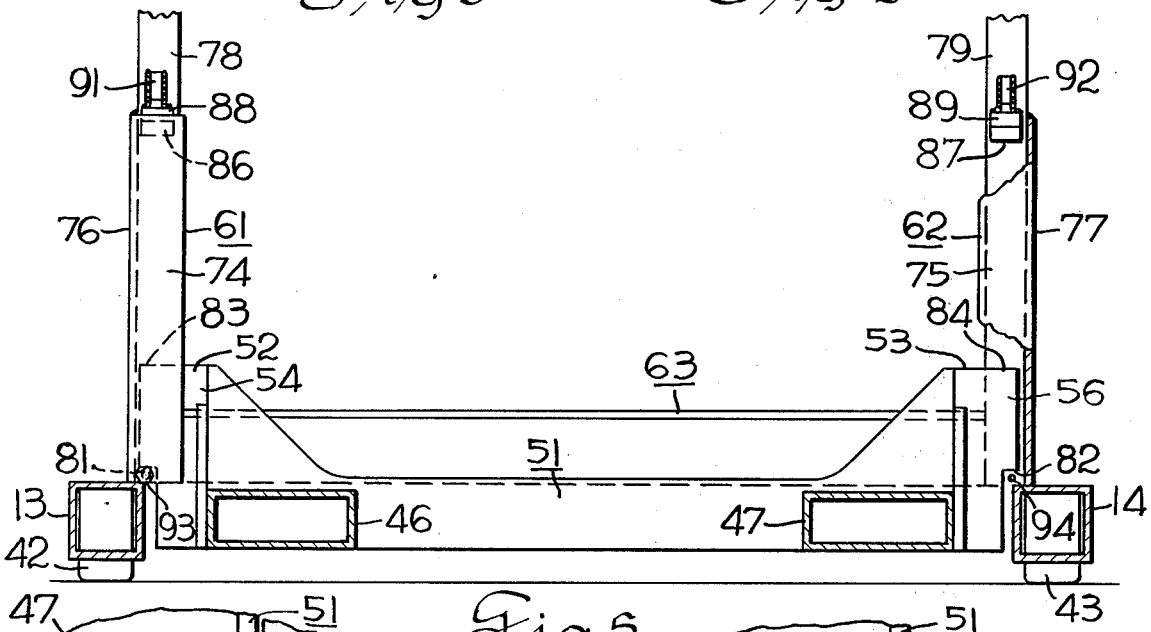
FIG. 5 is a section view taken along the line V—V in FIG. 3.
Figure 6:
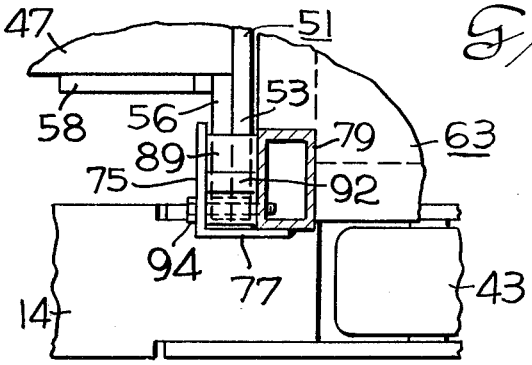
FIG. 6 is a section view taken along the line VI—VI in FIG. 3.
Figure 7:
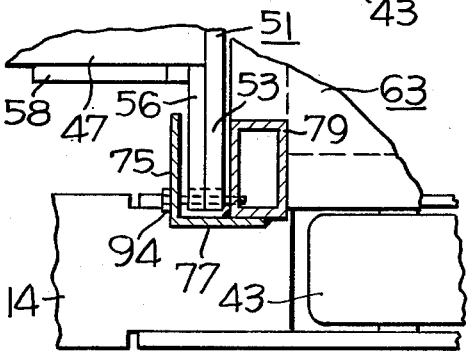
FIG. 7 is a section view taken along the line VII—VII in FIG. 3.

As shown in FIG. 4, the carriage 18 is moved upwardly from its nested, lowered position in pocket 17. The abutment surface 84 has engaged the resilient abutment 87 and the operator's platform 63 has been lifted off of the front ends of the support legs 13, 14. The resilient pads 86, 87 provide cushioning to prevent excessive shock from occurring when the operator's platform is picked up by the carriage. A pair of cap screws 93, 94 are provided at the bottom of the guide structures 61, 62 on the operator's platform in abuttable relation to the shoulders 81, 82 so as to prevent accidental withdrawal of the carriage guide structures 52, 53 downwardly therefrom.

From the foregoing description, it is apparent that applicants have provided a unique order picker lift truck wherein the side loading mechanism 50 which supports the payload is disposed near the mast whereas the operator's platform, which weighs less than the side loading mechanism 50 and its normal payload, is disposed at the forward end of the carriage, thus increasing the payload carrying capability over a construction wherein the operator's platform is adjacent the mast and the side loading mechanism is forward of the operator's platform. Applicants have also provided a novel lost motion connection between the operator's platform and the forward end of the carriage whereby the operator's platform rests on the frame of the truck when the carriage is lowered to its nested position within the pocket 17 of the frame and wherein the operator's platform will commence its upward movement with the carriage only after the carriage has been elevated a predetermined distance. This permits the operator to be lowered in relation to the loads being deposited and retrieved from an elevated rack storage area, thus making it more convenient for the operator to manipulate any of the load parcels by hand if it is necessary to do so. It also places the operator's eyes closer to the side loading attachment permitting greater accuracy in the side loading operation. By nesting the load support 15 within the upwardly opening pocket 17 of the frame 9 in the lowered position of the carriage, the side loading mechanism is lower than it otherwise would be, thus permitting the bottom shelf of the storage rack to be at the lowest possible height. This permits the storage capacity of the warehouse to be maximized.

The embodiments of the invention in which an exclusive property or privilege is claimed are defined as follows:

1. A lift truck comprising:

a main frame including
- a rear portion and
- a low, longitudinally elongated front portion rigidly secured to said rear portion having
  - a pair of laterally spaced and longitudinally extending legs rigidly secured at their rear ends to said rear portion and
  - a transverse brace extending between and rigidly secured to the front ends of said legs, said rear portion, legs and brace defining a vertically open pocket, a plurality of wheels supporting said main frame including a drive wheel steerably mounted on and in supporting relation to said rear portion and wheels mounted on the front ends of said legs, a vertical mast rigidly secured to said main frame at the rear of said pocket and at the front of said rear portion, a power unit on said rear portion rearwardly of said mast operatively connected to said drive wheel, a carriage mounted on said mast for vertical reciprocal movement between a lowered position and elevated positions, said carriage including a load support extending forwardly from said mast and disposed within said pocket in said lowered position of said carriage, a side loading mechanism supported on said load support, an operator's platform with truck operating controls disposed at the front of said load support forward of said side loading mechanism and supported on the forward part of said front portion of said main frame when said carriage is in said lowered position, vertically confronting abutments on said load support and said operator's platform, said abutments being spaced from one another a predetermined vertical distance when said carriage is in its lowered position, cooperating vertical guide structures on the front of said load support and the rear of the operator's platform, said guide structures permitting relative vertical motion between said operator's platform and said load support and preventing horizontal movement therebetween whereby said carriage is permitted to be elevated a predetermined distance from its lowered position before said abutments engage to elevate said operator's platform with said carriage.

* * * * *